US009695666B2

(12) United States Patent
Ruffo et al.

(10) Patent No.: US 9,695,666 B2
(45) Date of Patent: Jul. 4, 2017

(54) PACKER OR PLUG ELEMENT BACKUP RING WITH FOLDING FEATURE

(71) Applicant: BAKER HUGHES INCORPORATED, Houston, TX (US)

(72) Inventors: Antonio C. Ruffo, Cypress, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 225 days.

(21) Appl. No.: 14/504,594

(22) Filed: Oct. 2, 2014

(65) Prior Publication Data

US 2016/0097253 A1 Apr. 7, 2016

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 12/08; E21B 33/128
See application file for complete search history.

(56) References Cited

U.S. PATENT DOCUMENTS

| | | | | |
|---|---|---|---|---|
| 4,105,215 | A | 8/1978 | Rathburn | |
| 5,540,279 | A | 7/1996 | Branch et al. | |
| 5,701,959 | A | 12/1997 | Hushbeck et al. | |
| 5,961,123 | A | 10/1999 | Ingram et al. | |
| 6,695,051 | B2 | 2/2004 | Smith et al. | |
| 8,083,001 | B2 | 12/2011 | Conner et al. | |
| 9,267,353 | B2 * | 2/2016 | Xu | E21B 33/128 |
| 2006/0243457 | A1 * | 11/2006 | Kossa | E21B 33/1208 166/387 |
| 2013/0192853 | A1 | 8/2013 | Themig | |
| 2014/0190682 | A1 * | 7/2014 | Greenlee | E21B 33/13 166/118 |

* cited by examiner

*Primary Examiner* — Caroline Butcher
(74) *Attorney, Agent, or Firm* — Steve Rosenblatt

(57) ABSTRACT

A backup ring design for a packer sealing element features a folding shape where opposed legs are pushed together for extension in a radial direction toward the surrounding tubular to span the extrusion gap. The design can use a V-shape where the vertex is toward the mandrel and the legs are oriented toward the surrounding tubular. The legs in that instance can be thicker than the vertex thickness to aid in folding while providing enhanced strength at the surrounding tubular where shear forces apply as a result of seal compression against the surrounding tubular. The design features a single or multiple vertices that are similarly aligned or alternatingly oppositely aligned to create a zigzag shape in cross-section. Material selection can vary with the expected service conditions.

23 Claims, 2 Drawing Sheets

PACKER OR PLUG ELEMENT BACKUP RING WITH FOLDING FEATURE

FIELD OF THE INVENTION

The field of the invention is extrusion backup rings for packer sealing elements and more particularly rings that fold for extension to the surrounding tubular.

BACKGROUND OF THE INVENTION

When packer sealing elements are axially compressed to grow in radial dimension to the surrounding tubular they have a tendency to axially extrude. As a result backup rings are used to close the extrusion gap to maintain the integrity of the sealing element. Typically backup rings are made to overly the sealing element and are pushed out radially with the sealing element when axial compression of the sealing element takes place. To effectively accomplish this task the backup rings cannot be too stiff as they will leave gaps from the surrounding tubular wall through which parts of the sealing element will extrude. If the material is too soft the pressure in the sealing element can overcome the backup ring and extrude. Another concern of designs that overly the sealing element is what happens if the packer is to be released. Rings that are too stiff could remain extended against the surrounding tubular wall even after the sealing element is relaxed. As a result such rings can become twisted and mangled and could cause the released packer to stick in the hole which requires an expensive milling out.

Alternative designs have been developed to the overlapping design that use a tapered ring that is wedged out as the seal is axially compressed. Such designs are illustrated in US 20130192853; U.S. Pat. Nos. 5,701,959; and 5,540,279 (FIG. 5). The more traditional overlay design is seen in U.S. Pat. Nos. 5,961,123; 8,083,001 and 6,695,051. Of general interest in the area of backup rings is U.S. Pat. No. 4,105,215.

The present invention uses a folding or collapsing design for the backup rings that features a thinner wall at the bend location and a thicker wall at the opposed extremities. The preferred cross-sectional configuration is a V-shape where the legs extend toward the surrounding tubular and are thicker than at the fold where the legs are joined. In this way there is little resistance to folding and radial extension while placing the thicker walled legs adjacent the surrounding tubular. The V-shape can also be inverted putting the legs near the mandrel and the junction of the legs toward the surrounding tubular. In the latter case the junction can be made thicker than the legs or the other way around. The folding creates radial extension to the surrounding tubular for an effective extrusion barrier. The design also releases more easily when the seal is allowed to collapse. These and other features of the present invention will be more readily apparent to those skilled in the art from a review of the detailed description of the preferred embodiment and the associated drawings while appreciating that the full scope of the invention is to be determined by the appended claims.

SUMMARY OF THE INVENTION

A backup ring design for a packer sealing element features a folding shape where opposed legs are pushed together for extension in a radial direction toward the surrounding tubular to span the extrusion gap. The design can use a V-shape where the vertex is toward the mandrel and the legs are oriented toward the surrounding tubular. The legs in that instance can be thicker than the vertex thickness to aid in folding while providing enhanced strength at the surrounding tubular where shear forces apply as a result of seal compression against the surrounding tubular. The design features a single or multiple vertices that are similarly aligned or alternatingly oppositely aligned to create a zigzag shape in cross-section. Material selection can vary with the expected service conditions.

DETAILED DESCRIPTION OF THE PREFERRED EMBODIMENT

Figure 1:
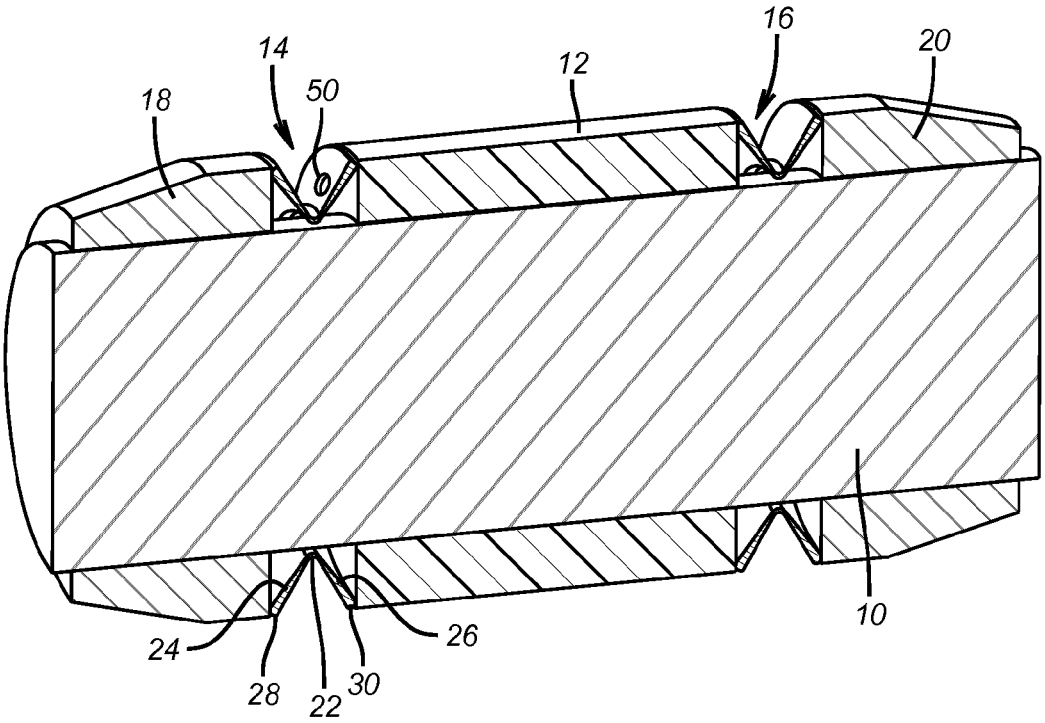
FIG. 1 shows a run in position for a packer with the v-shaped backup ring having a vertex closer to the mandrel.

FIG. 1 shows schematically a packer or plug with a mandrel 10 with a sealing element 12 mounted around it. The sealing element 12 is flanked on opposed sides by backup rings 14 and 16. Preferably the rings 14 and 16 are identical and in the same orientation as shown in FIG. 1 but other alternatives are envisioned. Each of the rings 14 and 16 extend for 360 degrees around the mandrel 10 and form a clearance, loose or interference fit with the mandrel 10. Flanking rings 14 and 16 rings 18 and 20 that schematically represent the axial compression system that will decrease the length and increase the diameter of sealing element 12 with relative movement toward each other.

Ring 14 will now be described with the understanding that when the rings 14 and 16 are the same, the description of ring 14 is applicable to ring 16. Ring 14 has a vertex 22 that can be the confluence of two straight legs 24 and 26. Alternatively a rounded transition of at least one radius is also envisioned. The vertex 22 is disposed closer to the mandrel 10 with the legs 24 and 26 jutting away from mandrel 10 an in a direction toward the surrounding tubular that is not shown. Preferably the legs get thicker towards ends 28 and 30. The reason for the legs getting thicker is best seen in the set position of FIG. 2. The set position of the sealing element 12 and the legs 24 and 26 is higher than the outer surface 32 of the ring 18 leaving a portion of the legs 24 and 26 sticking out further and preferably to a location in contact with the surrounding tubular that is not shown. As ring 14 acts as an extrusion barrier a part of it is unsupported by ring 18 making the ends 28 and 30 thicker adds strength for accomplishing the backup function. The transition to a greater thickness of the legs 26 and 24 moving away from the vertex 22 can be accomplished gradually or as a step transition, although a gradual thickening is preferred to avoid stress concentration that can create cracks.

Figure 2:
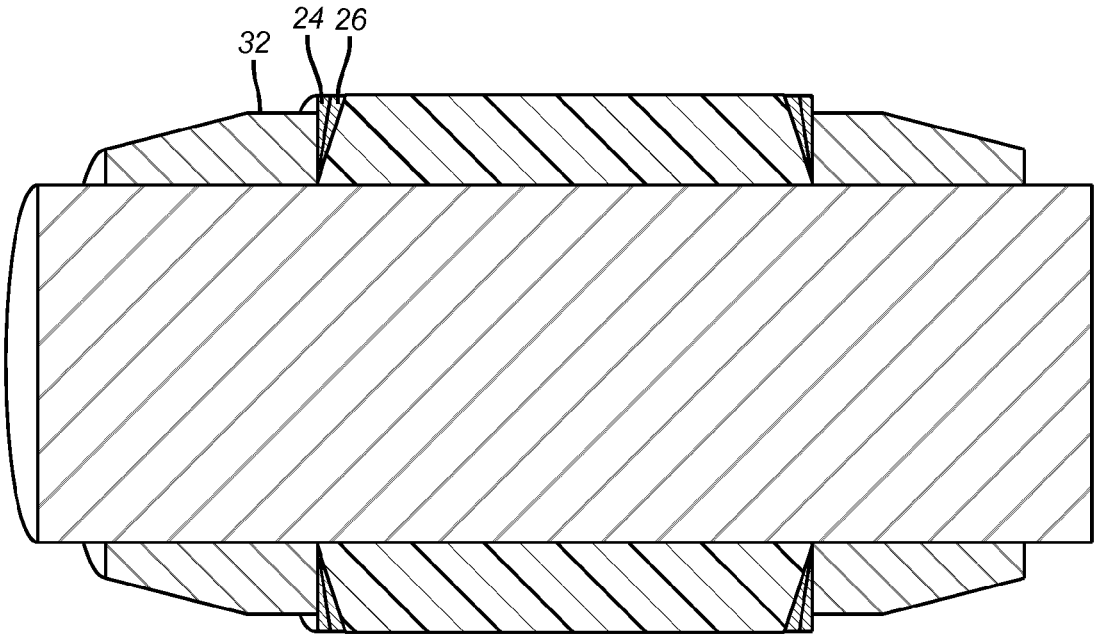
FIG. 2 is the view of FIG. 1 in the set position for the packer.

In the FIG. 2 set position the sealing element 12 and the ends 28 and 30 are preferably at the same height and in contact with the surrounding tubular that is not shown. In that way some support for the ends 28 and 30 could be obtained from the surrounding tubular wall. For running in as shown in FIG. 1 the ends 28 and 30 are preferably not extending any further than the outer surface of the sealing element 12 and can even be extending less than the unset sealing element 12.

Figure 3:
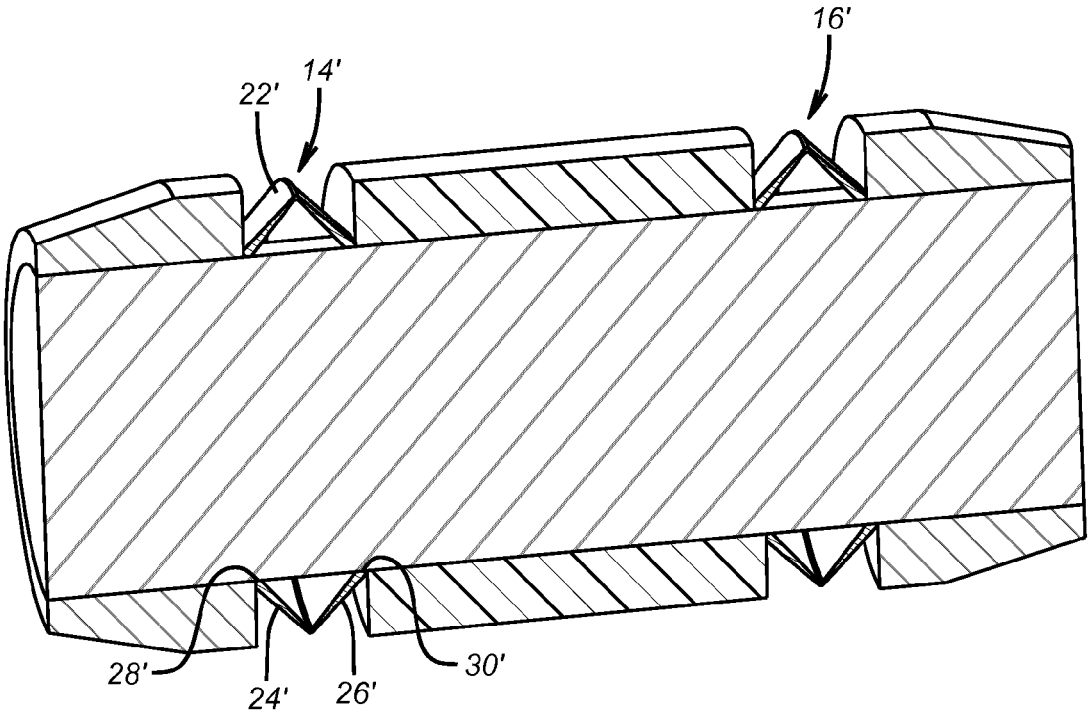
FIG. 3 shows the backup ring of FIG. 1 in the inverted position with the vertex away from the mandrel in the run in position.
Figure 4:
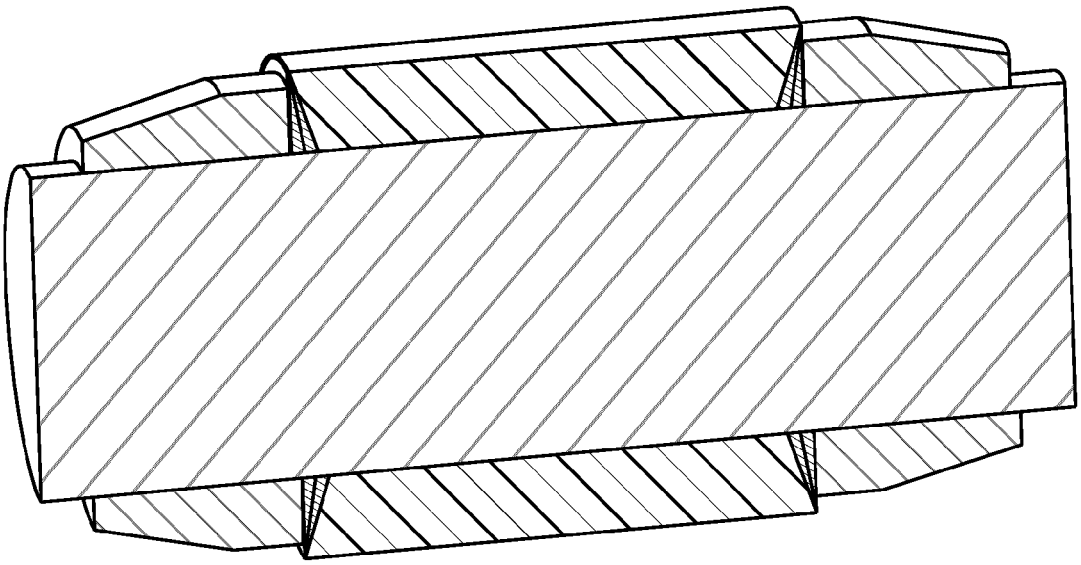
FIG. 4 is the view of FIG. 3 in the set position.

FIGS. 3 and 4 are the same as FIGS. 1 and 2 with the difference that rings 14' and 16' are inverted with vertex 22' being located away from mandrel 10' and ends 28' and 30' being near the mandrel 10'. In this case the legs 24' and 26' are shown as getting thicker toward the mandrel 10', however, the opposite arrangement is also contemplated where the vertex thickness is greater than the thickness at ends 28' and 30'. However, the latter alternative is less favored because it makes collapse of the legs 24' and 26' more difficult and for the simple matter that such greater thickness is not necessary at the vertex 22' when adjacent the surrounding tubular that is not shown because the fact of the fold of the vertex 22' being at the wall of the surrounding tubular lends the needed strength at that location to resist extrusion of the set sealing element 10'.

Variations are envisioned such as a repetition of the illustrated pattern to have multiple vertices 22 in each backup ring so that in section the ring has a zigzag profile. Alternatively, rings can be independent and abutting and still have the zigzag profile in section. The orientation of the vertex on one side of a sealing element can be the opposite of the orientation on the other side of the sealing element. The number of vertices on one side can be the same or different than on the opposite side. Rounded transitions of a single or multiple radii can be used instead of a sharp angle for the transition between the legs. The included angle for running in can be between 45 and 135 degrees with 60 degrees preferred. The rings 14 and 16 can be free floating, pinned or threaded to adjacent structures. Materials can be metals, composites or wire mesh. Optionally, openings 50 near the mandrel can be provided to allow an exit path for fluid displaced from volumes being reduced as the folding action commences.

The above description is illustrative of the preferred embodiment and many modifications may be made by those skilled in the art without departing from the invention whose scope is to be determined from the literal and equivalent scope of the claims below.

We claim:

1. A packer or plug assembly for selectively sealing against a borehole wall at a subterranean location, comprising:

a mandrel;

a sealing element mounted on said mandrel for selective actuation toward the borehole wall;

a backup ring assembly disposed adjacent at least one of opposed ends of said sealing element, said backup ring assembly and sealing element selectively axially compressed along said mandrel by an actuation assembly straddling said at least one backup ring;

said backup ring assembly further comprising a continuous ring comprising at least two diverging legs joined at a junction adjacent one end of said legs such that said legs define an empty gap therebetween which closes at said junction when said legs abut each other along their length under a force delivered by said actuation assembly with said sealing element in contact with the borehole wall.

2. The assembly of claim 1, wherein said junction forms a vertex.

3. The assembly of claim 2, wherein:

said vertex defines an included angle of between 45 and 135 degrees.

4. The assembly of claim 2, wherein:

said vertex has an arcuate shape.

5. The assembly of claim 2, wherein:

said vertex is disposed adjacent said mandrel.

6. The assembly of claim 2, wherein:

said vertex is disposed away from said mandrel.

7. The assembly of claim 1, wherein:

said legs have a variable thickness.

8. The assembly of claim 1, wherein:

the thickness of said legs varies gradually or in a step change.

9. The assembly of claim 1, wherein:

a thickest part of said legs is nearest or furthest from said junction.

10. The assembly of claim 1, wherein:

said legs extend radially from said mandrel further than said actuation assembly after said legs are pushed together.

11. The assembly of claim 1, wherein:

said backup ring is free floating, pinned or threaded with respect to said mandrel or said actuation assembly.

12. The assembly of claim 1, wherein:

said backup ring comprises a metal, composite or wire mesh material.

13. The assembly of claim 1, wherein:

said legs comprise free ends opposite said junction.

14. The assembly of claim 1, wherein:

said at least two legs joined at said junction comprises a plurality of pairs of opposed legs joined at discrete junctions.

15. The assembly of claim 14, wherein:

said plurality of pairs of legs are either an integral structure or a plurality of abutting structures.

16. The assembly of claim 1, wherein:

said backup ring assembly is disposed at opposed ends of said sealing element.

17. The assembly of claim 16, wherein:

said backup ring assembly is the same or different on opposed sides of said sealing element.

18. The assembly of claim 1, wherein:

said legs initially extend radially as much or less than said sealing element.

19. The assembly of claim 1, wherein:

said legs extend radially more than said actuation assembly when said legs are pushed together.

20. The assembly of claim 1, wherein:

at least one of said legs extend perpendicularly to the borehole wall when said legs are pushed together.

21. The assembly of claim 1, wherein:

the orientation of both said legs with respect to an axis of said mandrel when running in is away from a perpendicular orientation to said axis.

22. The assembly of claim 1, wherein:

said legs stop short of axially overlaying said actuation assembly or said seal assembly.

23. A packer or plug assembly for selectively sealing against a borehole wall at a subterranean location, comprising:

a mandrel;

a sealing element mounted on said mandrel for selective actuation toward the borehole wall;

a backup ring assembly disposed adjacent at least one of opposed ends of said sealing element, said backup ring assembly and sealing element selectively axially compressed along said mandrel by an actuation assembly straddling said at least one backup ring;

said backup ring assembly further comprising a continuous ring comprising at least two diverging legs joined at a junction adjacent one end of said legs such that said legs move toward each other under a force delivered by said actuation assembly to move said sealing element toward the borehole wall;

at least one of said legs comprises at least one opening for fluid displacement as said legs are pushed together, said opening closing when said legs contact each other.

* * * * *